US010007231B2

(12) United States Patent
Ueno

(10) Patent No.: US 10,007,231 B2
(45) Date of Patent: Jun. 26, 2018

(54) IMAGE FORMING APPARATUS

(71) Applicant: KYOCERA Document Solutions Inc., Osaka (JP)

(72) Inventor: Daijiro Ueno, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days. days.

(21) Appl. No.: 15/195,460

(22) Filed: Jun. 28, 2016

(65) Prior Publication Data

US 2017/0003647 A1 Jan. 5, 2017

(30) Foreign Application Priority Data

Jun. 30, 2015 (JP) ..... 2015-131396

(51) Int. Cl.
*G03G 21/20* (2006.01)
*G03G 15/00* (2006.01)

(52) U.S. Cl.
CPC ..... *G03G 21/206* (2013.01); *G03G 15/80* (2013.01)

(58) Field of Classification Search
CPC ..... G03G 15/80; G03G 21/206; G06F 1/183; H01L 23/40; H05K 7/20563; H05K 7/20572; H05K 7/1474
See application file for complete search history.

(56) References Cited

U.S. PATENT DOCUMENTS 5,887,226 A 3/1999 Taki
2008/0240767 A1* 10/2008 Asahina ..... G03G 21/206 399/92
2012/0051778 A1* 3/2012 Nishino ..... G03G 21/206 399/92
2012/0183314 A1* 7/2012 Nishino ..... G03G 21/206 399/44
2015/0016835 A1* 1/2015 Kakutani ..... G03G 21/1604 399/88
2016/0004215 A1* 1/2016 Yamashita ..... B41J 29/377 399/92

FOREIGN PATENT DOCUMENTS

JP H10-143053 A 5/1998
JP H11-133691 A 5/1999
JP 2002-023597 A 1/2002
JP 2002072124 A * 3/2002
JP 2002182545 A * 6/2002

* cited by examiner

*Primary Examiner* — Sevan A Aydin
(74) *Attorney, Agent, or Firm* — IP Business Solutions, LLC

(57) ABSTRACT

An image forming apparatus includes a cooling mechanism used for cooling, as a cooled object, either of a unit and a component forming the image forming apparatus. This cooling mechanism includes: a sub frame, a fan-attached part and a duct semi-completed part. The fan-attached part is formed on the frame in a manner such as to permit fan attachment thereto. The duct semi-completed part is provided on the frame for forming a duct introducing, to the cooled object, cooling wind generated by the fan attached to the fan-attached part, and has one non-formed wall part. Further, a circuit board can be attached to a portion of the non-formed wall part of the duct semi-completed part, and the duct is formed by the attached circuit board and the duct semi-completed part.

1 Claim, 9 Drawing Sheets

IMAGE FORMING APPARATUS

INCORPORATION BY REFERENCE

This application claims priority to Japanese Patent Application No. 2015-131396 filed on Jun. 30, 2015, the entire contents of which are incorporated by reference herein.

BACKGROUND

This disclosure relates to a cooling mechanism and an image forming apparatus, and more specifically to a technology for cooling a unit or a component forming an image forming apparatus.

Following an increase in the number of functions and downsizing of an image forming apparatus, there have been increasing needs for efficiently cooling an inside of the apparatus while adequately arranging a large number of units and components forming the image forming apparatus in a narrow space.

Thus, for example, an image forming apparatus has been suggested which has an electric circuit dispersed on a plurality of circuit boards and arranges each of the circuit boards in their respective storage spaces. An image forming apparatus has also been suggested which has a duct provided between a fixing unit and a process unit and has air flow through the duct to prevent an influence of heat of the fixing unit imposed on the process unit. Further known is an image forming apparatus which efficiently cools a plurality of cooled objects by directing blowing air from a single fan to the cooled object or guiding this air to the cooled object through the duct.

SUMMARY

As one aspect of this disclosure, a technology obtained by further improving the technology described above will be suggested.

A cooling mechanism according to one aspect of this disclosure is a cooling mechanism used for cooling, as a cooled object, either of a unit and a component forming an image forming apparatus.

The cooling mechanism includes: a fan, a fan-attached part, and a duct semi-completed part.

The fan-attached part is formed on the frame in a manner such as to permit fan attachment thereto.

The duct semi-completed part is provided on the frame for forming a duct introducing, to the cooled object, cooling wind generated by the fan attached to the fan-attached part, and has one non-formed wall part.

Further, a circuit board can be attached to a portion of the non-formed wall part of the duct semi-completed part, and the duct is formed by the attached circuit board and the duct semi-completed part.

An image forming apparatus according to one aspect of this disclosure includes: the cooling mechanism, and an image formation section performing image formation on a recording medium.

DETAILED DESCRIPTION

Figure 1:
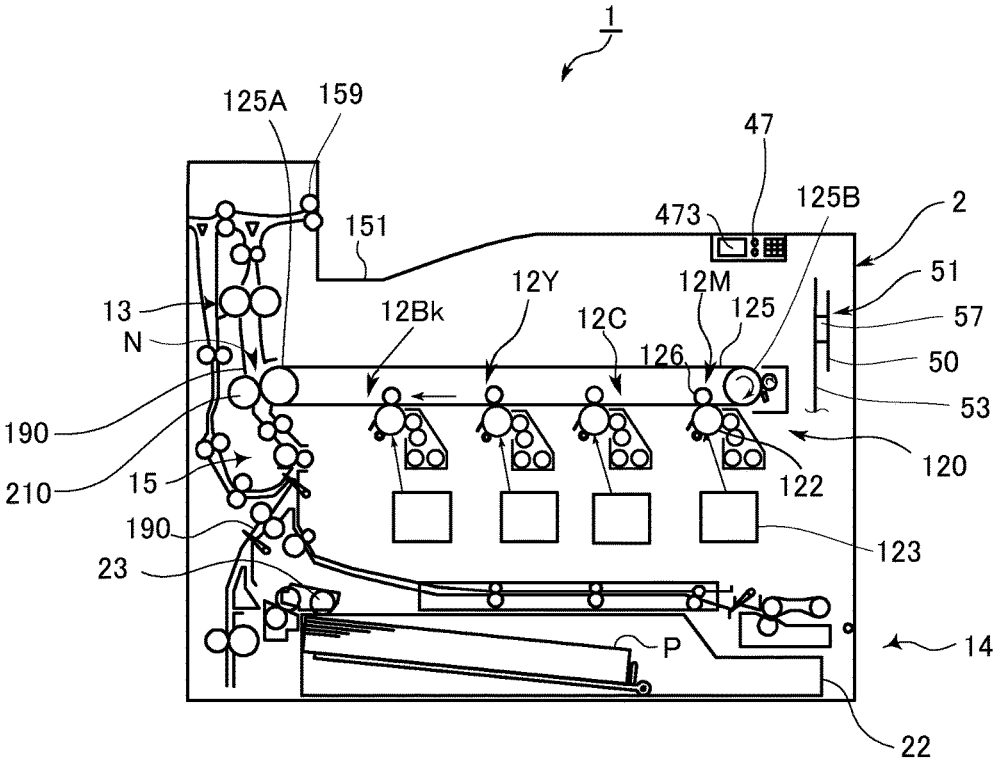
FIG. 1 is an elevational cross section showing an image forming apparatus according to one embodiment of this disclosure.
Figure 2:
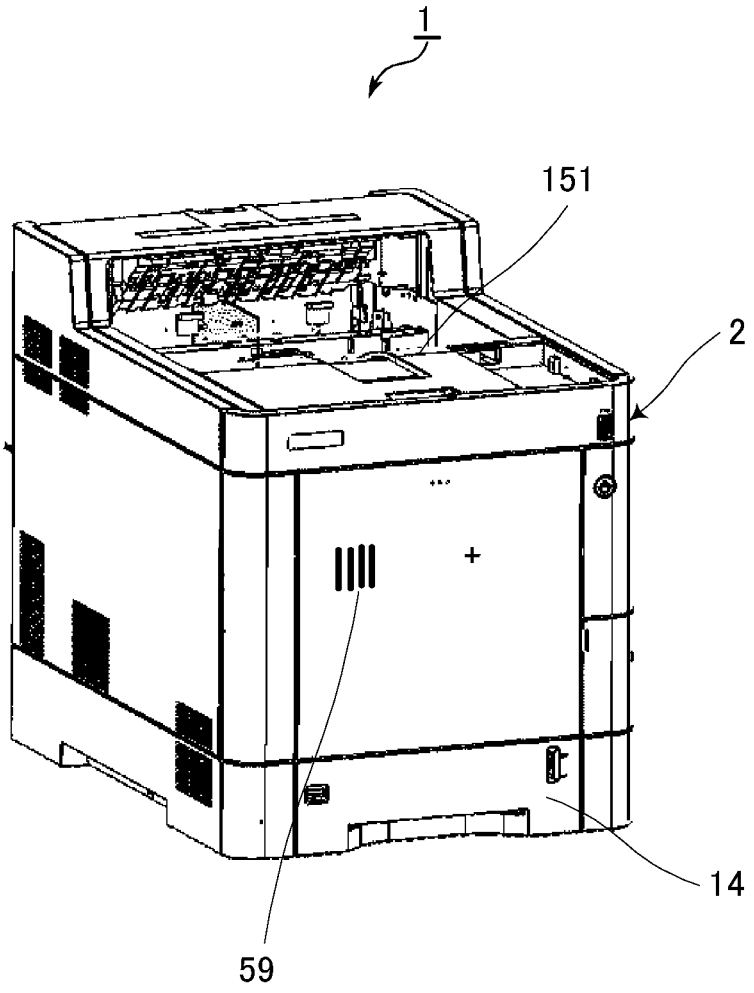
FIG. 2 is a perspective view showing outer appearance of the image forming apparatus.

Hereinafter, an embodiment of this disclosure will be described with reference to the drawings. FIG. 1 is an elevational cross section showing an image forming apparatus according to one embodiment of this disclosure. FIG. 2 is a perspective view showing outer appearance of the image forming apparatus.

As shown in FIGS. 1 and 2, the image forming apparatus 1 includes: an apparatus casing 2, an operation section 47, an image formation section 120, a fixing section 13, a paper feed section 14, a conveyance section 15, a cooling mechanism 51, etc.

The operation section 47 accepts instructions, such as an image formation operation execution instruction, from an operator, and also includes a display section 473 displaying, for example, an operation guide to the operator.

The image formation section 120, based on image data, forms a toner image on a recording paper P supplied from the paper feed section 14.

Image formation units 12M, 12C, 12Y, and 12Bk of the image formation section 120 each include: a photoconductive drum 122, a neutralization section neutralizing a surface of the photoconductive drum 122; a cleaning blade cleaning the surface of the photoconductive drum 122; a charging section evenly charging the surface of the photoconductive drum 122; an exposure section 123 exposing the surface of the photoconductive drum 122 to light and then forming an electrostatic latent image thereon; a developing section developing the electrostatic latent image on the surface of the photoconductive drum 122 into a toner image; and a primary transfer roller 126.

Onto an intermediate transfer belt 125, the respective toner images formed by the image formation units 12M, 12C, 12Y, and 12Bk are transferred by the primary transfer roller 126. The toner images of respective color components transferred in this manner are superposed on each other on the intermediate transfer belt 125 through transfer timing adjustment, turning into a color toner image. By a secondary transfer roller 210, this color toner image is secondarily transferred at a nip part N onto the recording paper P conveyed from the paper feed section 14 through a conveyance path 190. Then the fixing section 13 fixes the toner image on the recording paper P thereon through thermal compression. The recording paper P on which the color image already subjected to the fixing processing has been formed is discharged from a discharge tray 151.

Figure 3A:
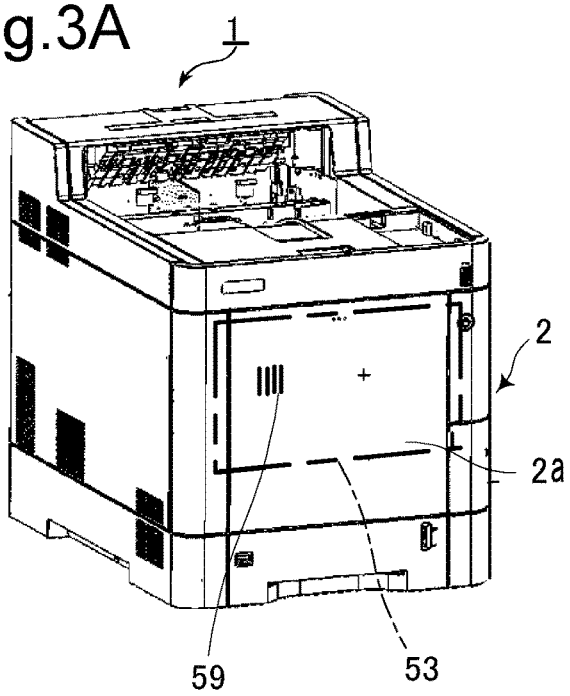
FIG. 3A is a perspective view showing outer appearance of the image forming apparatus.
Figure 3B:
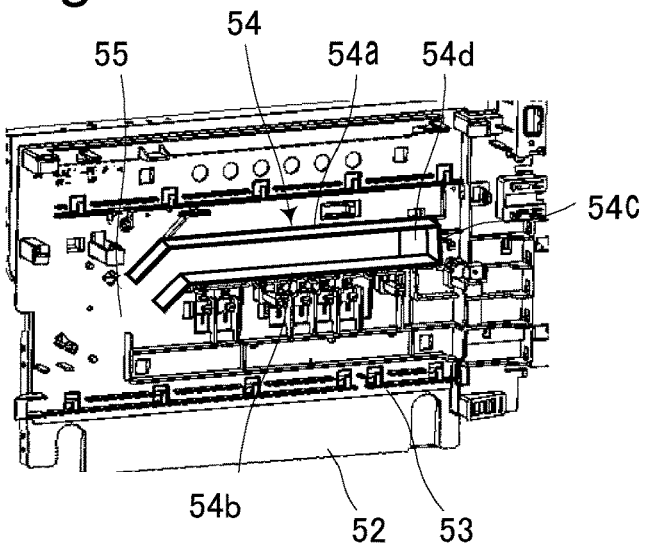
FIGS. 3B, 3C, 3D, and 3E are perspective views showing a cooling mechanism, etc. attached to a main body frame of the image forming apparatus.

Next, a cooling mechanism 51 will be described in detail. FIG. 3A is a perspective view showing outer appearance of the image forming apparatus 1 and FIGS. 3B to 3E are perspective views showing the cooling mechanism 51, etc. attached to a main body frame 52 of the image forming apparatus 1. Moreover, FIG. 4 is a perspective view showing a duct 57 of the cooling mechanism 51 in a broken form, and FIG. 5 is a plan view showing the cooling mechanism 51 on an enlarged scale. Further, FIG. 6 is a sectional view schematically showing the main body frame 52 and the cooling mechanism 51 viewed from a top of FIG. 2.

The cooling mechanism 51 is used for cooling, as a cooled object, units or its components forming the image forming apparatus 1. The cooling mechanism 51 is attached to the main body frame 52 to be part of the image forming apparatus 1. The cooling mechanism 51 includes: a sub-frame (one example of a frame in the scope of the claims) 53, a fan-attached part 55, and a duct semi-completed part 54.

Figure 6:
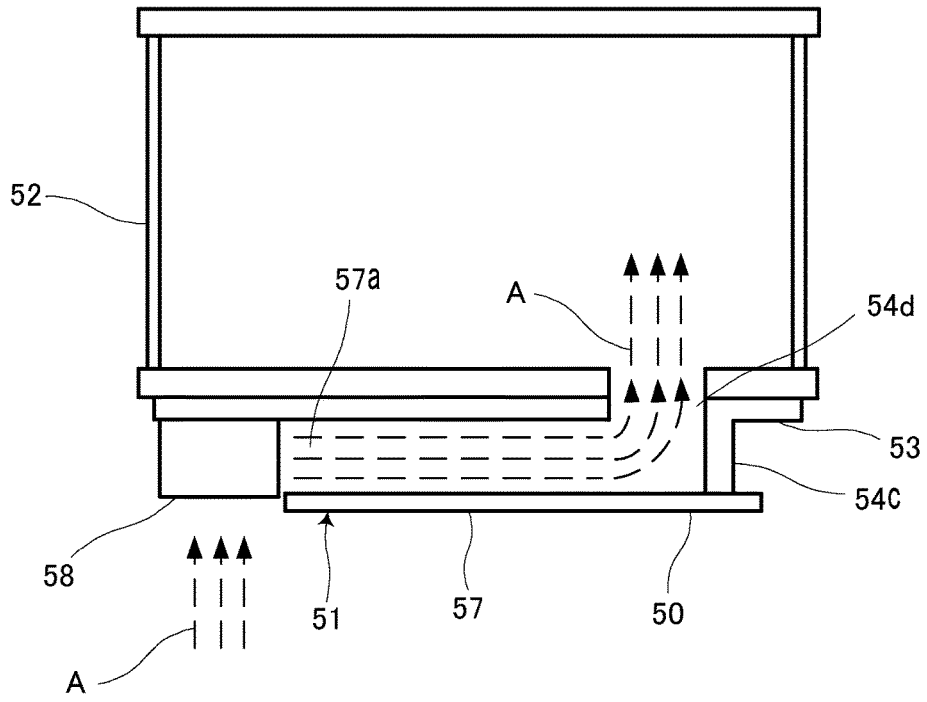
FIG. 6 is a sectional view schematically showing the main body frame and the cooling mechanism viewed from a top of FIG. 2.

The main body frame 52 shown in FIG. 6 is arranged inside of the apparatus casing 2 of the image forming apparatus 1, and supports a large number of components and units of the image forming apparatus 1 and the sub frame 53. As shown in FIGS. 3A and 3B, the sub frame 53 attached to the main body frame 52 is covered by a side wall part 2*a* of the apparatus casing 2. Formed at this sub frame 53 are the duct semi-completed part 54 and the fan-attached part 55. The duct semi-completed part 54 has an upper wall part 54*a*, a lower wall part 54*b*, a terminal end wall part 54*c*, and a communication port 54*d*, with only a non-formed side wall part of the duct 57, to be described later on. One end of the upper wall part 54*a* and one end of the lower wall part 54*b* are coupled together with the terminal end wall part 54*c* in between, and inside of the three wall parts 54*a*, 54*b*, and 54*c*, the communication port 54*d* is formed. Moreover, the upper wall part 54*a* and the lower wall part 54*b* are each bent obliquely downward on an another end side of the upper wall part 54*a* and the lower wall part 54*b*, and the fan-attached part 55 is provided at a position adjacent to another end of each of these wall parts 54*a* and 54*b*.

Figure 3C:
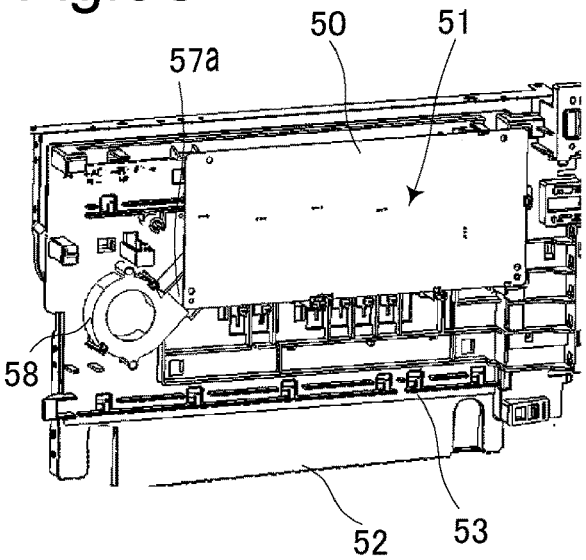
Figure 4:
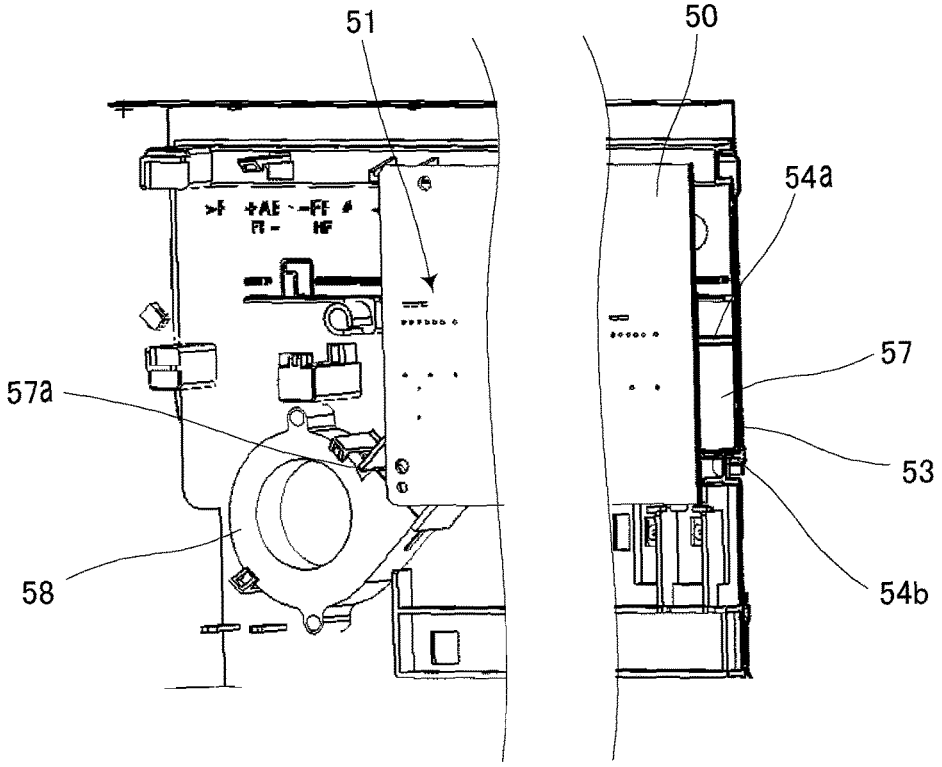
FIG. 4 is a perspective view showing a duct of the cooling mechanism in a broken form.
Figure 5:
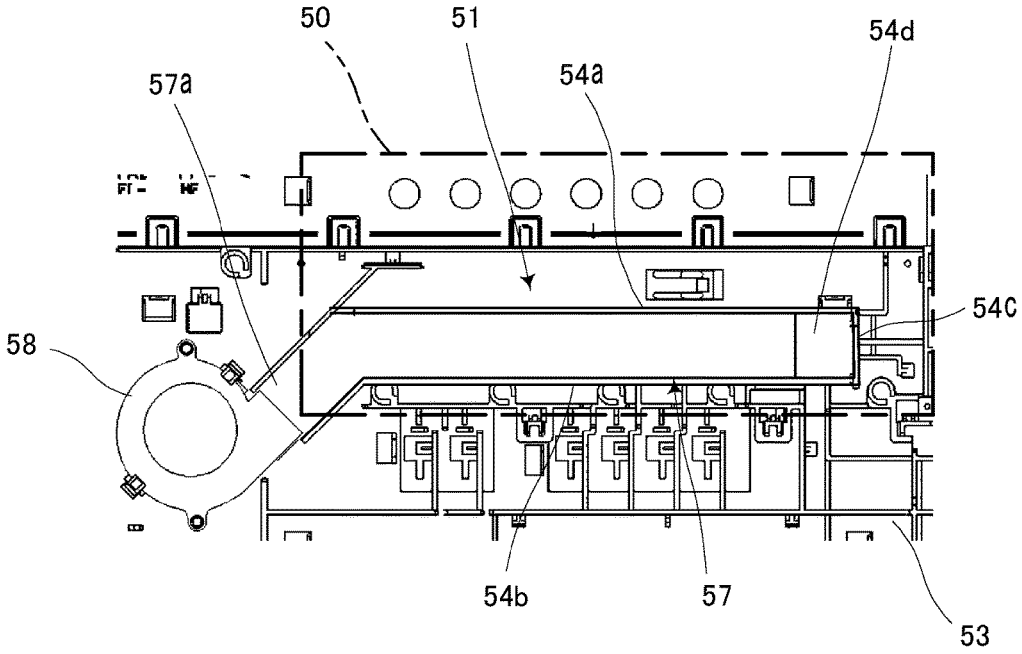
FIG. 5 is a plan view showing the cooling mechanism on an enlarged scale.

As shown in FIG. 3C, upon fixation of a circuit board 50 in such a manner as to be superposed on the upper wall part 54*a* and the lower wall part 54*b* of the duct semi-completed part 54, the duct 57 of a square tubular form composed of the circuit board 50, the upper wall part 54*a*, the lower wall part 54*b*, and (part of) the sub-frame 53 is formed as shown in FIG. 4. Specifically, the circuit board 50 is also used as a side wall part of the duct 57, completing the duct 57. This duct 57 has a suction port 57*a* directed to the fan-attached part 55 as shown in FIGS. 5 and 6, is closed at the terminal end wall part 54*c*, and is communicated with an inside of the image forming apparatus 1 through the communication port 54*d* and an opening part of the main body frame 52.

To the fan-attached part 55, a fan 58 is attached as shown in FIGS. 3C, 5, and 6. As shown in FIG. 3A, at the side wall part 2*a* of the apparatus casing 2, slits 59 are formed, and an air suction port of the fan 58 faces the slits 59.

Here, upon operation of the fan 58 as shown in FIG. 6, outside air is suctioned through the slits 59 of the apparatus casing 2 by the fan 58, and the air is blown into an inside of the duct 57 from the fan 58 through the suction port 57*a* of the duct 57. Then the air flows into the communication port 54*d* of the duct 57 through the duct 57 as shown by an arrow A, is blown out to the inside of the image forming apparatus 1 via the communication port 54*d* and the opening part of the main body frame 52, and is brown against an upwardly directed outer circumferential surface of the intermediate transfer belt 125. As a result, the intermediate transfer belt 125 is cooled, and further each photoconductive drum 122 in contact with the intermediate transfer belt 125 is also cooled.

When the circuit board 50 is attached to the duct semi-completed part 54 as described above, a cooled object on the circuit board 50, for example, an electronic component required to be cooled is included by the duct 57 formed by the upper wall part 54*a*, the lower wall part 54*b*, and the terminal end wall part 54*c*. That is, the duct 57 is so shaped as to include the cooled object on the carrier 50 therein. Upon flow of the air inside of the duct 57, the circuit board 50 is cooled, and, for example, components mounted on the circuit board 50 are also cooled.

Further, in the cooling mechanism 51, the circuit board 50 is also used as the side wall part of the duct 57, thus achieving space saving by an amount corresponding to the circuit board 50.

As described above, in this embodiment, by use of the single fan 58 and the duct 57, the intermediate transfer belt 125, each photoconductive drum 122, and the circuit board 50 arranged inside of the image forming apparatus 1 can be cooled, and the circuit board 50 is also used as the side wall part of the duct 57, thus achieving the space saving.

Figure 7:
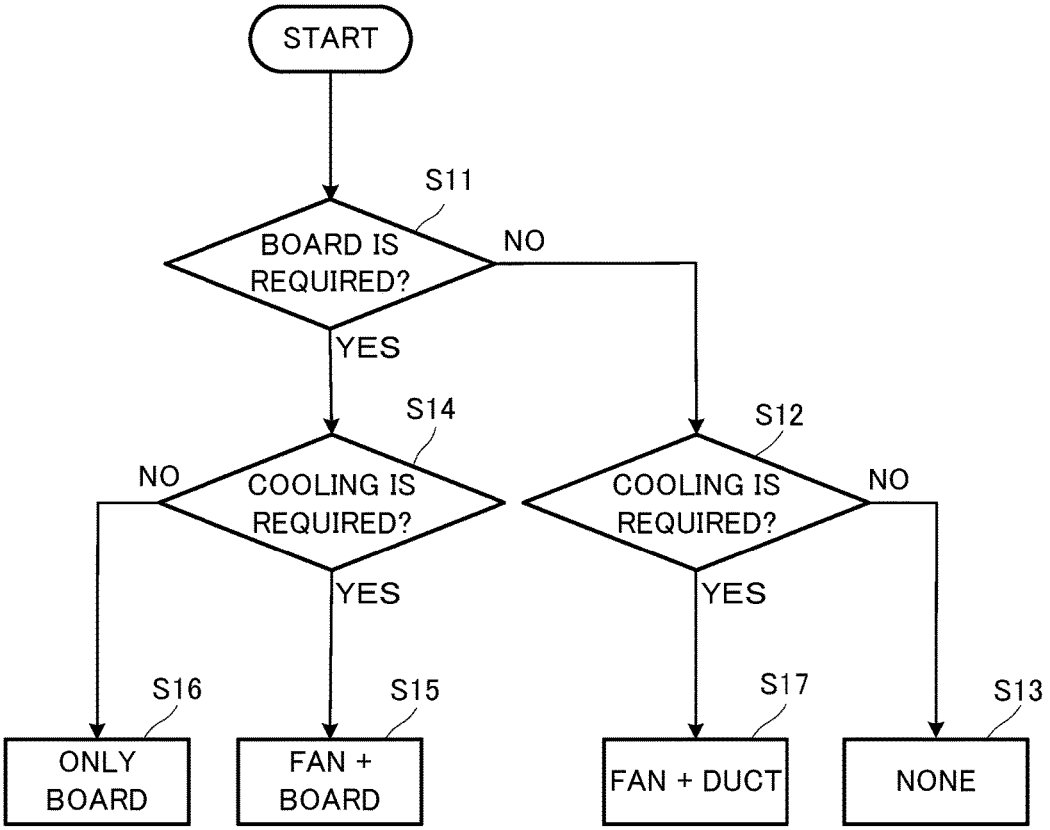
FIG. 7 is a flowchart used for illustrating processes of manufacturing the image forming apparatus.

Next, processes of manufacturing the image forming apparatus 1 of this embodiment will be described with reference to a flowchart shown in FIG. 7.

The processes of manufacturing this image forming apparatus 1 is based on assumption that while manufacturing the image forming apparatus 1 with basic configuration as shown in FIG. 1, unit addition following various functional changes of the image forming apparatus 1 and an increase in a process speed are supported. More specifically, even upon a change in necessity of the circuit board 50 and the cooling mechanism 51 in accordance with the unit addition and the increase in the process speed, it can be supported by selecting or not selecting the processes of attaching the circuit board 50 and the cooling mechanism 51.

For example, upon manufacture of the image forming apparatus 1 with only the basic functions, the circuit board 50 does not have to be attached ("NO" in step S11), the cooling mechanism 51 does not have to be attached either ("NO" in step S12). Thus, as shown in FIG. 3B, both the circuit board 50 and the fan 58 are not attached to the sub frame 53, and their attachment processes are omitted (step S13).

Moreover, upon manufacture of a high-function image forming apparatus 1 with units added and an increased process speed, the circuit board 50 needs to be attached ("YES" in step S11), and the cooling mechanism 51 also needs to be attached ("YES" in, step S14). Thus, as shown in FIG. 3C, a process of attaching the circuit board 50 to the duct semi-completed part 54 of the sub frame 53 and a process of attaching the fan 58 to the fan-attached part 55 of the sub frame 53 are performed (step S15). As a result of adding the circuit board 50 to the cooling mechanism 51 in this manner, the duct 57 is formed, whereby a cooling device including the duct 57 and the fan 58 is provided.

Figure 3D:
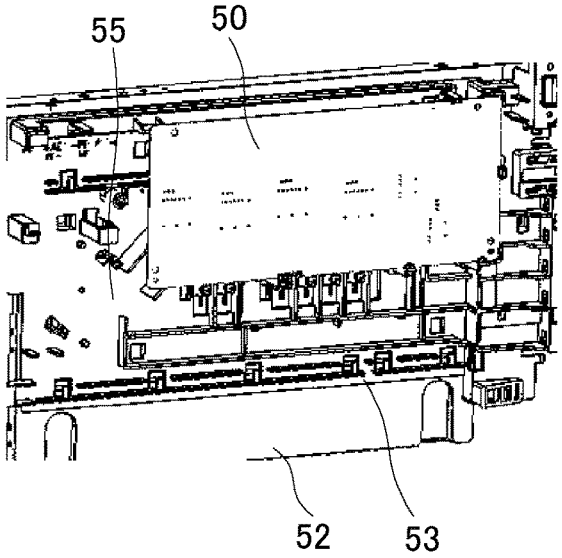

Further, upon manufacture of the image forming apparatus 1 with units added but without an increased process speed, the circuit board 50 needs to be attached ("YES" in step S11), but the cooling mechanism 51 does not have to be attached ("NO" in step S14). Thus, as shown in FIG. 3D, a process of attaching the circuit board 50 to the sub frame 53 is performed (step S16), and a processing of attaching the fan 58 is omitted.

Figure 3E:
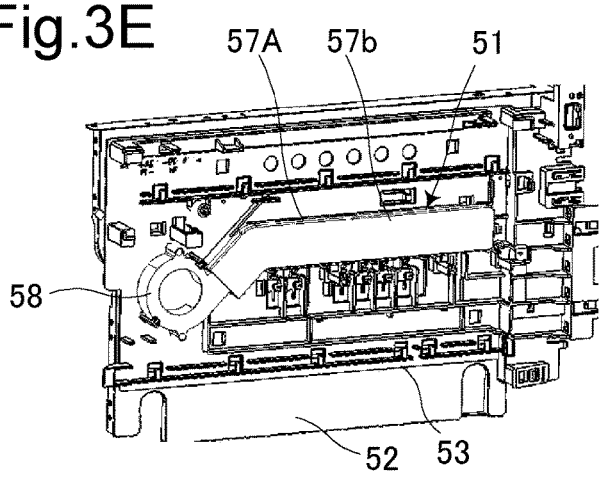

Moreover, upon manufacture of the image forming apparatus 1 without units added but with an increased process speed, the circuit board 50 does not have to be attached ("NO" in step S11), but the cooling mechanism 51 needs to be attached ("YES" in step S12). Thus, as shown in FIG. 3E, without attaching the circuit board 50 to the sub frame 53, a process of assembling a duct dedicated wall part 57*b* in place of the circuit board 50 to the upper wall part 54*a* and the lower wall part 54*b* of the duct semi-completed part 54 of the sub frame 53 is performed, whereby a duct 57A is formed. Moreover, a process of attaching the fan 58 to the fan-attached part 55 of the sub frame 53 is performed (step S17). As a result, a cooling mechanism 51 formed of a duct 57A and the fan 58 is provided.

Selection or non-selection among the respective processes for attaching the circuit board 50, the fan 58, and the duct dedicated wall part 57*b* to the sub frame 53 makes it easy to support the functional changes of the image forming apparatus 1. Moreover, the selective attachment of the circuit board 50 and the duct dedicated wall part 57*b* avoids waste of a component, achieving space saving.

For example, the image forming apparatus indicated in the Background has a plurality of circuit boards independently provided in their respective dedicated components, and thus is limited in space saving. Similarly, the current image forming apparatus has the duct itself as one dedicated component, and thus is limited in space saving.

On the contrary, in the embodiment described above, the circuit board 50 is also used as part of the duct 57A, thus making it possible to achieve further space saving.

Moreover, the configuration and processing described with reference to FIGS. 1 through 7 are just one embodiment of this disclosure, and are not intended to limit this disclosure to these configuration and processing.

What is claimed is:

1. An image forming apparatus comprising:

a frame;

a circuit board;

a fan generating cooling wind;

a fan-attached part, onto which the fan is attached, being formed on the frame as a part of the frame; and a duct semi-completed part being provided on the frame for forming a duct introducing, to a cooled object, cooling wind generated by the fan attached to the fan-attached part, the duct semi-completed part having one non-formed wall part, wherein the duct semi-completed part has an upper wall part, a lower wall part, and a terminal end wall part, which are formed at the frame, and a communication port provided on a position surrounded by the upper wall part, the lower wall part, and the terminal end wall part, and the upper wall part and the lower wall part form a suction port opening towards the fan-attached part, each of the upper wall part and the lower wall part extends from the suction port to the communication port along the frame and has a bend part for bending and changing a cooling wind passage, the bent part being provided on a portion that connects the suction port and the communication port, an air exhaust port of the fan is provided to be obliquely extended toward the suction port, a part of the circuit board is attached to a portion of the non-formed wall part of the duct semi-completed part by being superposed on the upper wall part and the lower wall part, and the part of the circuit board being attached to the portion of the non-formed wall part, the upper wall part, the lower wall part, and the part of the frame form the duct to be of a square tubular form, and the duct of the square tubular form formed by the attachment of the circuit board is formed in a manner so that the cooled object mounted on the part of the circuit board is included in an inside of the duct.

* * * * *